US006524129B2

(12) United States Patent
Cote et al.

(10) Patent No.: US 6,524,129 B2
(45) Date of Patent: Feb. 25, 2003

(54) ELECTRICAL INTERCONNECTION COMB

(75) Inventors: Sebastien Cote, Caluire (FR); Philippe France, Chazelles sur Lyon (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 09/880,900

(22) Filed: Jun. 15, 2001

(65) Prior Publication Data

US 2002/0031941 A1 Mar. 14, 2002

(30) Foreign Application Priority Data

Jun. 16, 2000 (FR) ..... 00 07743

(51) Int. Cl.[7] ..... H01R 31/08

(52) U.S. Cl. ..... 439/511; 439/751; 439/82; 439/885; 439/876

(58) Field of Search ..... 439/825, 751, 439/709, 82, 511, 885, 876

(56) References Cited

U.S. PATENT DOCUMENTS

| | | | | |
|---|---|---|---|---|
| 2,183,067 A | | 12/1939 | Gardner | 439/825 |
| 3,048,812 A | | 8/1962 | Heidler | 439/825 |
| 4,482,198 A | | 11/1984 | Crowley | |
| 4,737,114 A | * | 4/1988 | Yaegashi | 439/751 |
| 4,906,209 A | * | 3/1990 | Tanabe et al. | 439/751 |

FOREIGN PATENT DOCUMENTS

DE 44 00 469 A1 7/1995

* cited by examiner

*Primary Examiner*—Tho D. Ta
(74) *Attorney, Agent, or Firm*—Oliff & Berridge, PLC

(57) ABSTRACT

This comb includes a link bar (5) from which parallel contact plugs (6) extend. Each contact plug is in the form of a tooth (6) pierced by at least one longitudinal window (9) delimiting at least two connection branches (10, 12) which are parallel and deformed transversely in opposite directions one with respect to another and the adjacent edges of which, defined by the parallel edges of the window, are located at a certain distance from one another.

10 Claims, 1 Drawing Sheet

ELECTRICAL INTERCONNECTION COMB

BACKGROUND OF THE INVENTION

The present invention relates to the technical field of electrical interconnection combs used especially, but not exclusively, for ensuring interconnection of connection units for power cables.

Thus, an electrical interconnection comb is used to connect several electrical conductors and to bring them to the same potential. An interconnection comb according to the invention makes it possible more particularly to interconnect busbars in which slots are made, each being intended to take one tooth of an interconnection comb.

It is known to connect together several junction units placed one beside the other in order to guarantee the same potential at all the connections made in these junction units. A junction unit generally comprises an insulating casing in which a connection device connected to a busbar is mounted. To interconnect the units, a specific opening is generally provided in the insulating casing of the junction unit and, opposite this opening, a slot is made in the busbar so as to take a tooth of an interconnection comb.

Documents DE-44 00 469 and DE-44 11 306 describe interconnection devices comprising plugs, each plug having a pair of parallel connection branches which are separated by a longitudinal slot and are deformed transversely, in opposite directions, in order to define an elastically deformable connection region.

Such interconnection combs are generally produced by the cutting-out, flat, of a metal blank and by stamping the cut blank so as to shape the interconnection teeth. In this regard, it should be emphasized that the slot which separates the connection branches of each tooth is obtained by tearing-off the constituent material of the tooth when forming the teeth.

The interconnection combs thus produced are generally satisfactory and suitably fulfill their interconnection function during the first several times that they are used. However, it has been found that the quality of the electrical contact progressively deteriorates with repeated comb insertion and extraction operations so that the combs according to the prior art can no longer guarantee perfect interconnection of the devices that they connect.

There is therefore obviously a need to have an interconnection comb which obviates the abovementioned drawbacks and which has very good electrical connection characteristics even after a large number of insertions and extractions.

SUMMARY OF THE INVENTION

In order to achieve this objective, the invention relates to an electrical interconnection comb comprising a link bar from which parallel contact plugs extend, characterized in that each contact plug is in the form of a tooth pierced by at least one longitudinal window delimiting at least two connection branches which are parallel and deformed transversely in opposite directions one with respect to another and the adjacent edges of which, defined by the parallel edges of the window, are located at a certain distance from one another.

Moreover, the link bar and the various contact plugs of the comb are made as a single piece, thereby resulting in a simple structure. The transverse deformations of the connection branches in two opposed directions make it possible to increase the width of each tooth in the direction transverse to the plane of the interconnection comb. To make an electrical contact, this transverse width must be at least equal to the width of the slot into which the tooth must be inserted. The elasticity of the constituent material of each tooth allows it to be fitted into a slot and extracted therefrom by elastic deformation.

From the standpoint of its strength and reliability, it should be noted that since that end of each tooth for being inserted into the slot in a busbar is straight and parallel to the link bar, there is no risk of the former being damaged when the tooth is being inserted into the corresponding slot in a busbar.

According to one embodiment of this comb, each tooth is in the form of a metal blade of rectangular overall shape whose end edges lying on the same side as the link bar and on the opposite side lie in the same plane.

Advantageously, each tooth has two longitudinal parallel slots delimiting three branches, the central branch of which is deformed in one direction while the two side branches are deformed in the opposite direction.

This arrangement is beneficial in so far as it balances the transverse deformations on either side of the tooth, thus preventing any risk of the latter twisting.

According to another characteristic of the invention, the longitudinal window, separating two adjacent connection branches of each tooth of the comb, does not run into the free end of the tooth.

This advantageous characteristic of the invention prevents any inopportune splaying which could occur between the connection branches should there be no link between their ends, as is liable to occur in the interconnect on combs according to the prior art.

The invention also relates to a process for manufacturing an interconnection comb which consists

- cutting out a metal blank in order to delimit the link bar, the teeth and the longitudinal slots provided in the teeth;
- bending the central part of the branches of the teeth in two opposed directions, in order to deform the adjacent branches in opposite directions one with respect to another, while the free end of the teeth is straight and continues to lie in the plane of the link bar.

Various other characteristics of the invention will become apparent from the description below, given with reference to the appended drawings which illustrate a non-limiting embodiment of an interconnection comb according to the invention.

DETAILED DESCRIPTION OF EMBODIMENTS

Figure 1:
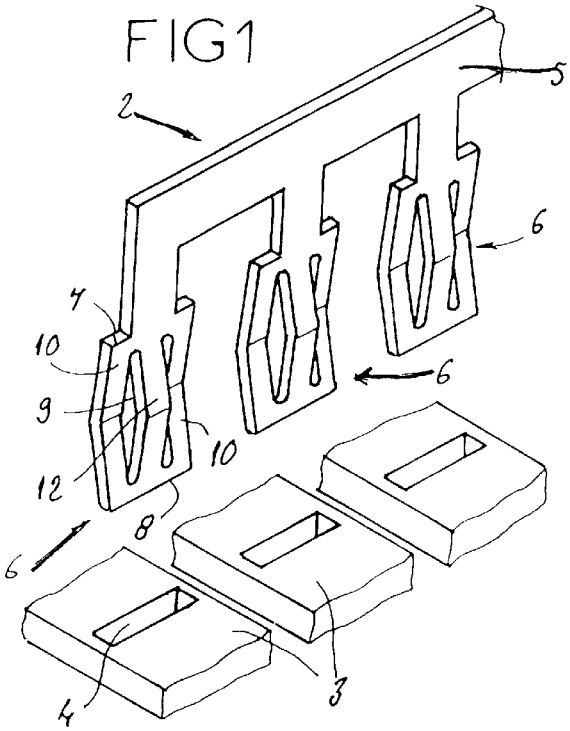
FIG. 1 is a perspective view of three busbars and the interconnection comb according to the invention.
Figure 2:
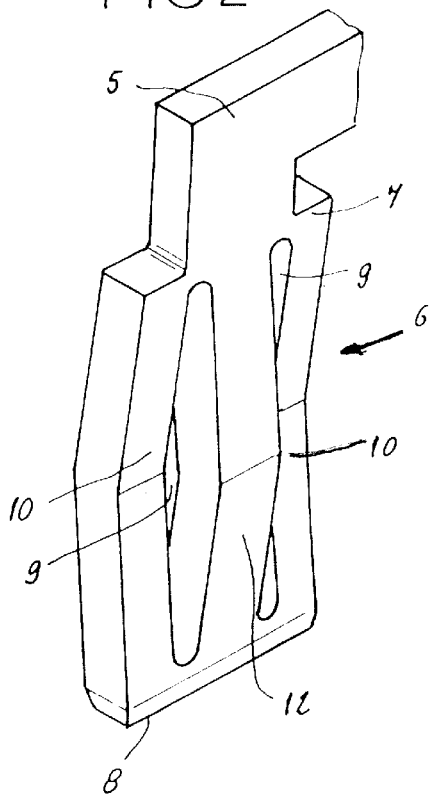
FIG. 2 is a perspective view on an enlarged scale of one tooth of this comb.

FIG. 1 snows an interconnection comb 2 and three busbars 3 associated with an electrical unit, such as a junction unit, which is not shown. Each busbar has a slot 4 of approximately rectangular shape, which extends transversely with respect to the busbar 3. The various slots 4 belonging to the various busbars 3 are aligned one with respect to another. The slots 4 are used to allow two busbars to be interconnected.

The interconnection comb 2 comprises a link bar 5, also called the base of the comb. Extending from the link bar 5 are a certain number of contact plugs, three of which are shown in the drawing, each having the shape of a tooth 6.

Figure 3:
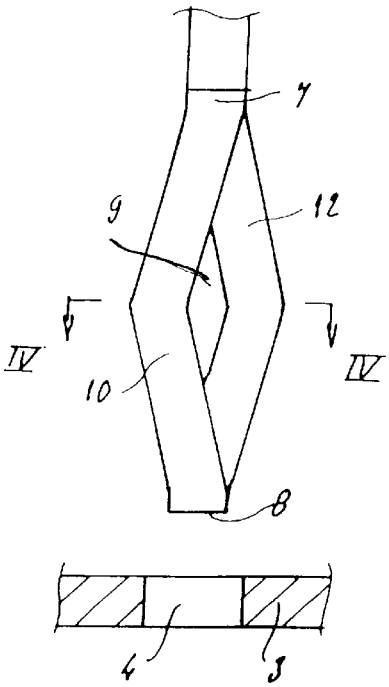
FIG. 3 is a side view of a tooth, the interconnection busbar into which it Is Intended to be fitted being shown in cross section.
Figure 4:
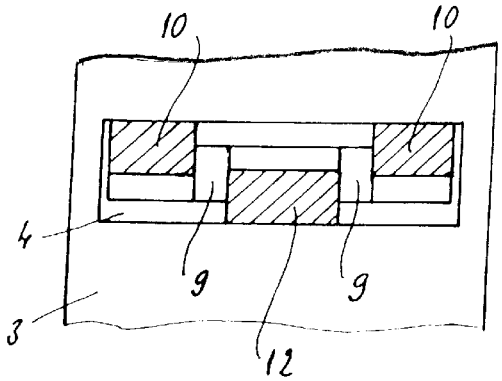
FIG. 4 is a view of a tooth in cross section on the line IV—IV in FIG. 3.

In the embodiment shown in the drawing, each tooth 6, which is plane, has a rectangular overall shape, having an end edge 7 lying on the same side as the link bar 5 and an opposite end edge 8 lying to the front in the direction of insertion of the tooth into a busbar 3. The tooth 6 has two parallel longitudinal windows 9, which do not run out to the end edge 8. The two windows 9 delimit two connection branches 10 located laterally on each side of a central connection branch 12. The two side branches 10 are deformed transversely to the tooth on one side of the plane of the latter, whereas the central branch 12 is deformed transversely on the other side of the plane of the tooth. It may be noted that the edges 8 of the end spaces lie in the same plane, which corresponds to the plane of the link bar 5. It is apparent from FIG. 3 that the deformations of the branches 10 and 12 are such that the width of the tooth is greater than the width of the slot 4 into which it has to be inserted.

In practice, the comb 2 is obtained from a metal blank which is cut out, on the one hand, to form the teeth 6 and, on the other hand, to provide the longitudinal windows 9 in these teeth. According to an essential characteristic of the invention, each longitudinal window has a large enough width for the adjacent edges of the two connection branches of any one tooth to lie at a certain distance from each other and to be unable to come into contact with each other during their movements. For this purpose, it is preferable, but not strictly necessary, for each longitudinal window to have a thickness of between 25% and 150% of the thickness of the constituent material of the tooth and preferably to be approximately equal to the thickness of the material. The branches 10 and 12 are then bent transversely approximately at mid-length in order to produce the desired deformation.

It should be noted that the figures are purely illustrative and that the proportions of the teeth, and especially the thickness of the latter, do not correspond to reality. In practice, the thickness is small enough to allow elastic deformation of the branches 10, 12 when the teeth are being inserted into the corresponding slots 4 in the busbars 3.

As will be apparent from the foregoing, the invention greatly improves the existing technique by providing an interconnection comb of simple structure which is easy to produce and is very reliable, on the one hand, in terms of electrical connection and, on the other hand, in terms of use insofar as successive operations incur no risk of damaging it.

According to the example illustrated above, each longitudinal window 9 has an approximately oblong shape and does not run into the free end of the tooth in which it is made. However, the longitudinal windows could have another shape as long as their edges are sufficiently far apart not to come into contact with each other during movements of the connection branches that they define. Likewise, the longitudinal windows could run into the free end of the teeth.

It goes without saying that the invention is not limited to the single embodiment of this comb, described hereinabove by way of example; on the contrary, it encompasses all variants thereof. Thus, in particular, the number of constituent branches of a tooth could be different, for example two, without thereby departing from the scope of the invention.

What is claimed is:

1. Electrical interconnection comb comprising: a link bar from which parallel contact plugs extend, wherein each contact plug is pierced by two longitudinal windows delimiting three connection branches which are longitudinally parallel, a central branch of said connection branches is deformed in one direction and adjacent to two side branches of said connection branches deformed in the opposite direction, and said connection branches have edges that define opposite sides of said windows, and the edges of said central branch and either of said two side branches being separated by a distance from one another along a direction transverse to the opposite sides.

2. Interconnection comb according to claim 1, wherein each said plug is in the form of a metal blade of rectangular overall shape having a link end disposed adjacent to the link bar and a free end opposite to the link bar, said link end and said free end lying in a same plane.

3. Interconnection comb according to claim 1, wherein each said longitudinal window is closed at a free end disposed opposite to the link bar.

4. Interconnection comb according to claim 1, wherein each said longitudinal window has an oblong shape.

5. Interconnection comb according to claim 1, wherein said distance separating the edges of adjacent branches is between 25% and 150% of a thickness of a material from which the plug is made.

6. Interconnection comb according to claim 1, wherein said distance separating the edges of adjacent branches is approximately equal to a thickness of a material from which the plug is made.

7. Process for manufacturing an interconnection comb according to claim 1, the process comprising:

cutting out a metal blank in order to delimit the link bar, the plugs and the longitudinal windows provided in the plugs;

bending the central part of the branches of the plugs in two opposed directions, in order to deform the adjacent branches in opposite directions one with respect to another, wherein a free end of the plug remains straight and disposed in a plane defined by the link bar.

8. Electrical interconnection comb comprising: a link bar from which parallel contact plugs extend, wherein each contact plug is pierced by two longitudinal windows delimiting three connection branches which are longitudinally parallel, a central branch of said connection branches is deformed in one direction and adjacent to two side branches of said connection branches deformed in the opposite direction, and said connection branches have edges that define opposite sides of said windows, and said edges of said central branch and either of said side branches are separated to avoid contact between each other when said three connection branches are undeformed.

9. Interconnection comb according to claim 8, wherein each said longitudinal window is closed at a free end disposed opposite to the link bar.

10. Interconnection comb according to claim 8, wherein each said longitudinal window has an oblong shape.

* * * * *